United States Patent [19]

Maeda et al.

[11] Patent Number: 4,925,596

[45] Date of Patent: May 15, 1990

[54] LUBRICATING OIL COMPOSITION CONTAINING MOLYBDENUM AND ZINC COMPOUNDS FOR INTERNAL COMBUSTION ENGINE

[75] Inventors: Yoshihiro Maeda; Kunihiko Hosonuma; Keiichi Tamura, all of Toda, Japan

[73] Assignees: Kyodo Oil Technical Research Center Co., Ltd.; Nippon Mining Company, Limited, both of Tokyo, Japan

[21] Appl. No.: 233,749

[22] Filed: Aug. 18, 1988

[30] Foreign Application Priority Data

Aug. 19, 1987 [JP] Japan ..... 62-204267

[51] Int. Cl.[5] ..... C10M 135/04

[52] U.S. Cl. ..... 252/32.7 E; 252/35; 252/32.7 R

[58] Field of Search ..... 252/32.7 E, 35, 42.7, 252/32.7 R

[56] References Cited

U.S. PATENT DOCUMENTS

| | | | |
|---|---|---|---|
| 4,290,902 | 9/1981 | Levine et al. . | |
| 4,428,861 | 1/1984 | Bridger . | |
| 4,456,538 | 6/1984 | Ripple . | |
| 4,456,539 | 6/1984 | Shim | 252/46.7 |
| 4,481,125 | 11/1984 | Holgado | 252/32.7 E |
| 4,626,366 | 12/1986 | Frentrup | 252/32.7 E |

FOREIGN PATENT DOCUMENTS

| | | |
|---|---|---|
| 0113045 | 7/1984 | European Pat. Off. . |
| 0220426 | 5/1987 | European Pat. Off. . |
| 408426 | 4/1940 | Japan . |
| 44-27366 | 11/1969 | Japan . |
| 52-39704 | 3/1977 | Japan . |
| 56-53190 | 5/1981 | Japan . |
| 56-110796 | 9/1981 | Japan . |
| 59-122597 | 7/1984 | Japan . |
| 62-43491 | 2/1987 | Japan . |
| 2185492 | 7/1987 | United Kingdom . |

OTHER PUBLICATIONS

Patent Abstracts of Japan, vol. 10, No. 262, (C-371) [2318], Sep. 6, 1986.

Patent Abstracts of Japan, vol. 3, No. 133, (C-63), Nov. 7, 1979.

Patent Abstracts of Japan, vol. 12, No. 117, (C-487) [2964], Apr. 13, 1988.

*Primary Examiner*—William R. Dixon, Jr.

*Assistant Examiner*—James M. Hunter, Jr.

*Attorney, Agent, or Firm*—Oblon, Spivak, McClelland, Maier & Neustadt

[57] ABSTRACT

A lubricating oil composition for the internal combustion engine comprising (i) a mineral lubricating base oil, a synthetic lubricating base oil or a mixture thereof, (ii) a specified amount of at least one alkyl molybdenum dithiophosphate having secondary alkyl

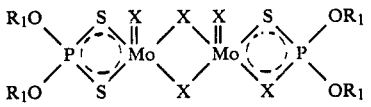

(I)

wherein $R_1$ is a secondary alkyl group having from 5 to 8 carbon atoms, X is O or S which may be the same or different, and the O/S ratio is from 3/1 to 1/3, and (iii) a specified amount of at least one alkyl zinc dithiophosphate having a primary alkyl group represented by the formula (II)

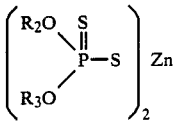

(II)

wherein $R_2$ and $R_3$ are each a primary alkyl group having from 3 to 8 carbon atoms which may be the same or different, and (iv) an additive of the lubricating oil containing the above components (b) and (c) for use in internal combustion engines.

4 Claims, No Drawings

LUBRICATING OIL COMPOSITION CONTAINING MOLYBDENUM AND ZINC COMPOUNDS FOR INTERNAL COMBUSTION ENGINE

BACKGROUND OF THE INVENTION

1. Field of the Invention

This invention relates to a lubricating oil composition used for internal combustion engines such as gasoline engine and Diesel engine. Particularly it relates to a lubricating oil composition for internal combustion engines which has remarkable effects on both preventing abrasion of valve-moving systems and saving energy, and to a lubricating oil additive used for the composition.

2. Description of the Prior Art

Lubricating oils have recently been required to have increasingly severe performance from the standpoint of saving resources and energy.

As to the lubricating oils for the internal combustion engines, in particular, saving energy type lubricating oils are strongly desired which enhance mechanical efficiency by decreasing friction loss.

Although it is one method for saving fuel cost to reduce viscosity of the lubricating oils, the method is substantially limited.

In order to improve specific fuel consumption by incorporating friction decreasing agents to the lubricating oils and reducing boundary friction, organic molybdenum compounds have generally been used as the friction decreasing agents.

As to such organic molybdenum compounds, primary alkyl molybdenum dithiophosphate prepared by using primary alcohol has been disclosed in, for example, U.S. Pat. Nos. 4,456,538, 4,428,861 and 4,290,902, Japanese Patent Publication Nos. 8426/1965 and 27366/1969, and Japanese Patent Laid-Open Nos. 110796/1981 and 43491/1987. Lubricating oil compositions obtained by the addition of organic molybdenum compounds have been disclosed in Japanese Patent Laid-Open Nos. 39704/1977, 53190/1981 and 122597/1984.

The above organic molybdenum compounds and lubricating oil compositions are found to have considerable effect from the viewpoint of saving energy due to decrease of friction.

The present inventors previously developed a lubricating oil composition in order to improve the specific fuel consumption of the internal combustion engines (Japanese Patent Laid-open No. 240388/1987). The composition contains as requisite components molybdenum dithiophosphate substituted with secondary alkyl groups having 5 or 8 carbon atoms, alkyl zinc dithiophosphate, specific perbasic metal type detergent-dispersant and ashless type detergent-dispersant.

The said lubricating oil composition has a remarkable effect on the decrease in abrasion and improvement in the specific fuel consumption. However, there is a problem that prevention of abrasion in the valve-moving systems, that is, prevention of pitting abrasion at engine cam nose and inhibition of scuffing of rocker pad are dependent upon the selection of alkyl groups of alkyl zinc dithiophosphate.

SUMMARY OF THE INVENTION

The object of this invention is to provide a lubricating oil composition for internal combustion engines which is excellent in the prevention of abrasion in the internal combustion engines and also has a remarkable effect on energy saving.

In order to achieve above object, the present inventors have investigated the effect obtained by combining alkyl groups of the above alkyl molybdenum dithiophosphate and those of alkyl zinc dithiophosphate. As a result, it has been found that a lubricating oil obtained by using molybdenum dithiophosphate having secondary type alkyl groups in combination with alkyl zinc dithiophosphate having primary type alkyl groups exhibits a marked energy-saving effect and an excellent abrasion resistance of the valve-moving systems.

The lubricating oil composition for the internal combustion engines in this invention contains:

(a) a mineral lubricating base oil and/or a synthetic lubricating base oil;

(b) from 0.005 to 0.2 wt.%, as a molybdenum concentration on the basis of the base oil, of at least one compound represented by the formula (I):

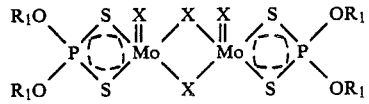

(I)

wherein $R_1$ is a secondary type alkyl group having from 5 to 8 carbon atoms, X is O or S and may be the same or different, and the O/S ratio is from 3/1 to 1/3; and (c) from 0.2 to 1.5 wt.% as a zinc concentration on the basis of the base oil, of at least one compound represented by the formula (II):

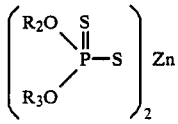

(II)

wherein $R_2$ and $R_3$ are a primary alkyl group having from 3 to 8 carbon atoms and may be the same or different.

DESCRIPTION OF THE PREFERRED EMBODIMENTS

The organic molybdenum compound of the above formula (I) which is added as the component (b) in this invention is a secondary alkyl molybdenum dithiophosphate having secondary type alkyl group. The secondary type alkyl group has from 5 to 8 carbon atoms and the carbon atom linked to oxygen atom is a secondary carbon. The secondary type alkyl groups represented by $R_1$ in the formula (I) are shown illustratively:

3-pentyl group of the formula $H_3C-CH_2-\underset{|}{CH}-CH_2-CH_3$, 2-pentyl group of the formula $H_3C-CH_2-CH_2-\underset{|}{CH}-CH_3$, 3- and 2-hexyl groups of the formulas $$H_3C-CH_2-CH_2-\underset{|}{CH}-CH_2-CH_3$$

-continued and $H_3C-\underset{\underset{CH_3}{|}}{CH}-CH_2-\underset{|}{CH}-CH_3$, 4- and 3-heptyl groups of the formulas $H_3C-CH_2-CH_2-\underset{|}{CH}-CH_2-$ $CH_2-CH_3$ and $H_3C-CH_2-CH_2-CH_2-\underset{|}{CH}-CH_2-CH_3$, and 2, 3 and 4-octyl group of the formula $H_3C-CH_2-CH_2-CH_2-$ $CH_2-CH_2-\underset{|}{CH}-CH_3$, $H_3C-CH_2-CH_2-CH_2-CH_2-\underset{|}{CH}-CH_2-CH_3$ and $H_3C-CH_2-CH_2-CH_2-\underset{|}{CH}-CH_2-CH_2-CH_2$.

The members represented by X.in the formula (I) are oxygen atoms or sulfur atoms. It is preferred to have on the average two sulfur atoms out of four X. Desired properties are obtained when the ratio of oxygen atoms to sulfur atoms, that is, O/S is in the range of from 1/3 to 3/1.

The content of the organic molybdenum compound is from 0.005 to 0.2 wt.%, and preferably from 0.01 to 0.1 wt.% as molybdenum concentration on the basis of the base oil. The content below this range lowers friction decreasing effect whereas the content above this range does not substantially enhance the effect.

Alkyl zinc dithiophosphate represented by the formula (II) which is added as the component (c) in combination with the said component (b) in this invention has been used to date as an antioxidant or an abrasion preventing agent of lubricating oils. A particularly important requirement in this invention is that the alkyl group types represented by $R_2$ and $R_3$ in the above formula (II) are alkyl groups having primary type structure and from 3 to 8 carbon atoms.

The primary type alkyl groups represented by $R_2$ and $R_3$ in the formula (II) are illustratively shown as follows:

$CH_3-CH_2-CH_2-$, $CH_3-CH_2-CH_2-CH_2-$, $CH_3-\underset{\underset{CH_3}{|}}{CH}-CH_2-$, $CH_3-CH_2-CH_2-CH_2-CH_2$, $CH_3-\underset{\underset{CH_3}{|}}{CH}-CH_2-CH_2-$, $CH_3-CH_2-CH_2-CH_2-CH_2-CH_2-$, $CH_3-\underset{\underset{CH_3}{|}}{CH}-CH_2-CH_2-CH_2-$, -continued $CH_3-CH_2-\underset{\underset{CH_3}{|}}{CH}-CH_2-CH_2-$, $CH_3-CH_2-CH_2-CH_2-CH_2-CH_2-CH_2-$, $CH_3-\underset{\underset{CH_3}{|}}{CH}-CH_2-CH_2-CH_2-CH_2-$, $CH_3-CH_2-\underset{\underset{CH_3}{|}}{CH}-CH_2-CH_2-CH_2-$, $CH_3-CH_2-CH_2-CH_2-CH_2-CH_2-CH_2-CH_2-$, $CH_3-\underset{\underset{CH_3}{|}}{CH}-CH_2-\underset{\underset{CH_3}{|}}{CH}-CH_2-CH_2-$ In this invention, from 0.2 to 1.5 wt.% of the organic zinc compound is added to the base oil in combination with the above organic molybdenum compound. The lubricating oil thus obtained has further improved effect on the friction decrease, enhancement in the specific fuel consumption and prevention of abrasion in the valve-moving systems. The amount less than 0.2 wt.% of the above organic zinc compound cannot give satisfactory improvement on the above effects whereas the amount more than 1.5 wt.% does not substantially improve the above effects.

Engine test results using lubricating oils, each of which has been obtained by adding to a base oil a compound of the formula (I) shown in Table 1 in combination with compound(s) of the formula (II) shown in Table 1, are illustrated in Table 1. In the table, improvement in specific fuel consumption is shown on the basis of a reference lubricating oil to which neither the compound of the formula (I) nor the compound(s) of the formula (II) is added.

As illustrated in Table 1, only when the organic molybdenum compound of the formula (I) having secondary type alkyl groups of 8 carbon atoms is used in combination with the organic zinc compound of the formula (II) having primary type alkyl groups of from 3 to 6 carbon atoms, the resulting lubricating oil (Sample No. 8 in Table 1) is very effective simultaneously for the improvement of specific fuel consumption and also for the prevention of abrasion in the valve-moving systems. That is, it is practically difficult to expect the above both effects by other combinations of compounds having above mentioned alkyl groups. When the above organic molybdenum compound or the organic zinc compound is used singly, the improvement in specific fuel consumption cannot be attained.

When the organic molybdenum compound having primary type alkyl groups is used in combination with the organic zinc compound, the specific fuel consumption is improved whereas violent abrasion takes place in the valve-moving systems. When the organic molybdenum compound having secondary type alkyl groups is used in combination with the organic zinc compound having secondary type alkyl groups, there is also a problem that violent abrasion similarly occurs in the valve-moving systems.

TABLE 1

| Sample No. | $R_1$ in formula (I) | $R_2$ and $R_3$ in formula (II) | Improvement in specific fuel consumption | Abrasion prevention in valve-moving system |
|---|---|---|---|---|
| 1 | Primary, $C_5$ | — | No | No pitting abrasion |
| 2 | Secondary, $C_8$ | — | No | " |
| 3 | — | Primary, $C_3$–$C_6$ mixture | No | " |
| 4 | — | Secondary, $C_6$ | No | " |
| 5 | Primary, $C_5$ | Primary, $C_8$ | Yes | Heavy pitting abrasion |
| 6 | Primary, $C_5$ | Secondary, $C_6$ | Yes | " |
| 7 | Secondary, $C_8$ | Secondary, $C_6$ | Yes | " |
| 8 | Secondary, $C_8$ | Primary, $C_3$–$C_6$ mixture | Yes | No pitting abrasion |

As the base oil used in this invention, mineral oils, various synthetic oils or mixtures thereof can be employed in a broad range, preferred dynamic viscosity of the base oil is 3–20 centistokes at 100° C.

Auxiliary additives usually employed in the field can also optionally be added in this oil composition.

These auxiliary additives include, for example, detergent-dispersants such as calcium sulfonate, magnesium sulfonate and magnesium phenate, ashless type detergent-dispersants such as alkenylsuccinimide, antioxidants, pour point depressants and antifoaming agents.

This invention and effects thereof will hereinafter be described in detail by way of examples. However it is not to be understood that the invention is restricted by these examples.

EXAMPLE

In these examples, lubricating oils having basic compositions (referred to as reference oil) illustrated below are prepared. Various kinds of alkyl molybdenum dithiophosphate (abbreviated as Mo-DTP) and alkyl zinc dithiophosphate (abbreviated as Zn-DTP) were mixed in combination or singly with the reference oil to obtain corresponding lubricating oils. The lubricating oils thus obtained were compared their performance between the lubricating oils of the examples and those of comparative examples. The results are illustrated in Table 3.

Composition of reference oil:

Refined mineral base oil was mixed with the following additives to obtain reference oil having a viscosity of 67 centistokes at 40° C. and a viscosity index of 109.

Overbasic type magnesium sulfonate: 0.9 wt.%

Alkenylsuccinimide: 5.0 wt.%

Phenolic antioxidant: 0.8 wt.%

TABLE 2

| | (Mixing proportion) | | | |
|---|---|---|---|---|
| | Mo-DTP | | Zn-DTP | |
| No. | Alkyl group | Amount (ppm as Mo) | Alkyl group | Amount (wt. % as Zn) |
| Example of the invention | | | | |
| 1 | $C_8$-Secondary | 300 | $C_3$~$C_6$-Primary | 0.8 |
| 2 | $C_5$-Secondary | 300 | $C_8$-Primary | 0.8 |
| 3 | $C_6$-Secondary | 300 | $C_8$-Primary | 0.8 |
| Comparative Example | | | | |
| 4 | $C_8$-Primary | 300 | — | — |
| 5 | $C_5$-Secondary | 300 | — | — |
| 6 | $C_8$-Secondary | 300 | — | — |

TABLE 2-continued

| | (Mixing proportion) | | | |
|---|---|---|---|---|
| | Mo-DTP | | Zn-DTP | |
| No. | Alkyl group | Amount (ppm as Mo) | Alkyl group | Amount (wt. % as Zn) |
| 7 | — | — | $C_8$-Primary | 0.8 |
| 8 | — | — | $C_8$-Secondary | 0.8 |
| 9 | $C_5$-Primary | 300 | $C_8$-Primary | 0.8 |
| 10 | $C_8$-Secondary | 300 | $C_6$-Secondary | 0.8 |
| 11 | $C_8$-Primary | 300 | $C_6$-Secondary | 0.8 |
| 12 | $C_6$-Secondary | 300 | $C_6$-Secondary | 0.8 |

TABLE 3

| | (Performance) | | | |
|---|---|---|---|---|
| | | | Valve-moving system abrasion | |
| | No. | Fuel saving(1) (%) | Pitting evaluation(2) | Scuffing evaluation(3) |
| Example of the invention | | | | |
| | 1 | +3.93 | 0 | 4.3 |
| | 2 | +4.33 | 0 | 4.3 |
| | 3 | +4.10 | 0 | 3.8 |
| Comparative Example | | | | |
| | 4 | +1.73 | 0 | 1.8 |
| | 5 | +1.12 Ⓜ | 0 | 0 |
| | 6 | +1.14 | 0 | 0 |
| | 7 | +0.56 | 0 | 15.0 |
| | 8 | +0.64 | 0 | 19.4 |
| | 9 | +5.45 | 17.3 | 0.3 |
| | 10 | +3.40 | 6.3 | 18.2 |
| | 11 | +3.60 | 6.3 | 2.9 |
| | 12 | +4.25 | 12.2 | 0.5 |

(Note)

(1)Fuel savings: Evaluated by amount of fuel consumption g/PS · hr. Compared with a reference oil.

(2)Pitting evaluation: Indicated by the generated area (%) of pitting abrasion on the surface of engine cam nose.

(3)Scuffing evaluation: Disadvantage caused by scuffing abrasion of rocker pad is indicated by marks.

As illustrated in Table 3, the lubricating oils of this invention (No. 1–3) are excellent in both properties of fuel saving and moving value abrasion resistance.

On the other hand, the lubricating oils of comparative examples increase either pitting abrasion or scuffing abrasion by changing the combination of alkyl groups as illustrated in No. 9–12.

What is claimed is:

1. A lubricating oil composition for an internal combustion engine comprising:

(a) a mineral lubricating base oil, a synthetic lubricating base oil or mixtures thereof;

(b) from 0.005 to 0.2 wt.%, as a molybdenum concentration on the basis of the base oil, of at least one compound represented by formula (I):

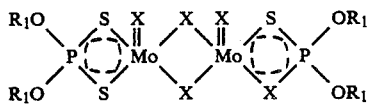

(I)

wherein $R_1$ is a secondary alkyl group having from 5 to 8 carbon atoms, X is O or S and are same or different, and the O/S ratio of the compound is from 3/1 to 1/3; and (c) from 0.2 to 1.5 wt.% , as a zinc concentration on the basis of the base oil, of at least one compound represented by the formula (II):

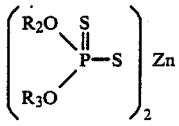

(II)

wherein $R_2$ and $R_3$ are a primary alkyl group having from 3 to 8 carbon atoms and are the same or different.

2. The composition as claimed in claim 1 wherein $R_1$ of the formula (I) is one member selected from the group consisting of 3-pentyl, 2-pentyl, 3-hexyl, 2-hexyl, 4-heptyl, 3-heptyl, 2-octyl, 3-octyl and 4-octyl.

3. The composition as claimed in claim 1 wherein the compound of formula (I) is present in an amount of from 0.01 to 0.1 wt.% on the basis of the base oil.

4. An additive of lubricating oil for an internal combustion engine comprising a combination of:

(A) at least one alkyl molybdenum dithiophosphate represented by formula (I):

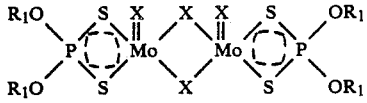

(I)

wherein $R_1$ is a secondary alkyl group having from 5 to 8 carbon atoms, X is O or S and are the same or different, and the O/S ratio of the compound is from 3/1 to 1/3; and (B) at least one alkyl zinc dithiophosphate represented by formula (II):

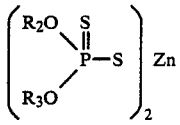

(II)

wherein $R_2$ and $R_3$ are a primary alkyl group having from 3 to 8 carbon atoms and are the same or different.

* * * * *

UNITED STATES PATENT AND TRADEMARK OFFICE

CERTIFICATE OF CORRECTION

PATENT NO. : 4,925,596

DATED : MAY 15, 1990

INVENTOR(S) : MAEDA, et al.

It is certified that error appears in the above-identified patent and that said Letters Patent is hereby corrected as shown below:

Title Page:

In the Abstract, delete

"

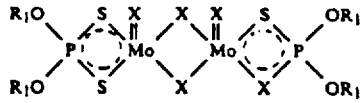

(I)

"

and replace it with

--

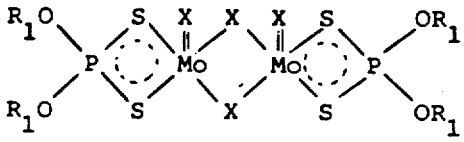

(I)

--.

Column 3, line 24, change

" $H_3C-CH_2-CH_2-CH_2-\underset{|}{CH}-CH_2-CH_2-CH_2.$ "

to

-- $H_3C--CH_2--CH_2--CH_2--\underset{|}{CH}--CH_2--CH_2--CH_3$ --.

Column 3, line 56, change

" $CH_3-\underset{\underset{CH_3}{|}}{CH}-CH_2-, CH_3-CH_2-CH_2-CH_2-CH_2,$ "

to

-- $CH_3--\underset{\underset{CH_3}{|}}{CH}--CH_2-, CH_3--CH_2--CH_2--CH_2--CH_2-$ --.

UNITED STATES PATENT AND TRADEMARK OFFICE

CERTIFICATE OF CORRECTION

PATENT NO. : 4,925,596

DATED : MAY 15, 1990

INVENTOR(S) : MAEDA, et al.

It is certified that error appears in the above-identified patent and that said Letters Patent is hereby corrected as shown below:

Column 7, delete

"

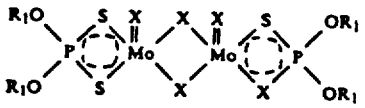

(I)

"

and replace it with

--

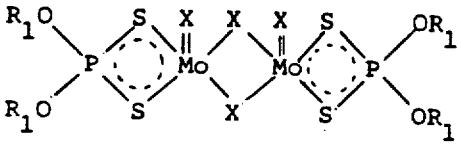

(I)

-- .

Signed and Sealed this

Eighth Day of September, 1992

*Attest:*

*Attesting Officer*

DOUGLAS B. COMER

*Acting Commissioner of Patents and Trademarks*